US009642395B2

(12) United States Patent
Kesselman et al.

(10) Patent No.: US 9,642,395 B2
(45) **Date of Patent: *May 9, 2017**

(54) RECLOSABLE PACKAGE WITH MAGNETIC CLASP AND DETACHABLE TRAY FOR ROLLING PAPERS USED IN SMOKING ARTICLES

(71) Applicant: BBK TOBACCO & FOODS, LLP, Phoenix, AZ (US)

(72) Inventors: Joshua Kesselman, Vancouver (CA); Ryan Selby, Vancouver (CA)

(73) Assignee: BBK TOBACCO & FOODS, LLP, Phoenix, AZ (US)

( * ) Notice: Subject to any disclaimer, the term of this patent is extended or adjusted under 35 U.S.C. 154(b) by 817 days.

This patent is subject to a terminal disclaimer.

(21) Appl. No.: 14/044,667

(22) Filed: Oct. 2, 2013

(65) Prior Publication Data

US 2015/0090275 A1 Apr. 2, 2015

(51) Int. Cl.

| | |
|---|---|
| ***B65D 51/00*** | (2006.01) |
| ***A24F 17/00*** | (2006.01) |
| ***B65D 5/42*** | (2006.01) |
| ***A24D 1/02*** | (2006.01) |

(52) U.S. Cl.

CPC ..... *A24F 17/00* (2013.01); *A24D 1/02* (2013.01); *A24D 1/022* (2013.01); *B65D 5/4266* (2013.01)

(58) Field of Classification Search

CPC ..... A24F 17/00; B65D 5/4266; B65D 2543/00388

USPC ..... 206/237, 246, 494

See application file for complete search history.

(56) References Cited

U.S. PATENT DOCUMENTS 6,296,178 B1 * 10/2001 McKenna, Sr. ..... B65D 5/0025 229/165
8,584,854 B2 * 11/2013 Kesselman ..... A24D 1/02 131/105
2004/0200852 A1 * 10/2004 Allison ..... A24F 17/00 221/33

FOREIGN PATENT DOCUMENTS

DE 20317744 * 11/2003
GB 299747 A * 10/1928 ..... A24F 15/14

* cited by examiner

*Primary Examiner* — Michael H Wilson
*Assistant Examiner* — Eric Yaary
(74) *Attorney, Agent, or Firm* — Weiss & Moy, P.C.; Jeffrey D. Moy

(57) ABSTRACT

A reclosable package for containing smoking papers to be dispensed therefrom, the package comprising: a body for holding the smoking papers; the body having a cover which overlays a surface of the body of the package for closure; wherein the cover opens to form a tray; and wherein the cover and/or body include a closure positioned to form a clasp when the cover is folded over the body.

17 Claims, 7 Drawing Sheets

RECLOSABLE PACKAGE WITH MAGNETIC CLASP AND DETACHABLE TRAY FOR ROLLING PAPERS USED IN SMOKING ARTICLES

CROSS REFERENCE TO RELATED APPLICATIONS

The present application is a continuation of U.S. Patent Application entitled, "RECLOSABLE PACKAGE WITH MAGNETIC CLASP AND DETACHABLE TRAY FOR ROLLING PAPERS USED IN SMOKING ARTICLES", Filed May 19, 2010, and having U.S. Ser. No. 12/783,358 in the name of the same inventor which is a continuation-in-part of U.S. application Ser. No. 12/714,230, filed on Feb. 26, 2010, entitled RECLOSABLE PACKAGE WITH MAGNETIC CLASP FOR ROLLING PAPERS USED IN SMOKING ARTICLES, which is a continuation-in-part of U.S. application Ser. No. 11/671,892, filed on Feb. 6, 2007, entitled INTERLEAVED TRANSPARENT CELLULOSE PAPER WITH OPAQUE ADHESIVE.

FIELD OF THE INVENTION

This invention is related in general to the field of products used by an end user to create their own cigars or cigarettes. More particularly, the invention is related to a reclosable package with magnetic clasp and a tray for rolling papers used in roll your own smoking articles.

BACKGROUND

Rolling papers used for rolling smoking articles, such as cigars or cigarettes, may be made from a variety of materials such as reconstituted tobacco and paper. Other rolling paper products utilize a highly transparent cellulose paper, which can be made from cellulose of wood, cotton, or hemp that is blended with glycerin or a glycerin alternative, and water.

Generally, these rolling papers are available in a packages of rolling papers or boxes of papers. However, the traditional packaging leaves much to be desired. A deficiency of the prior art packaging for rolling papers is an inadequate closure of the package or box of papers. In general, the rolling paper packages fail to remain closed, and, with routine use, the packages become worn, and remain open even more easily. When carrying the rolling paper package in a pocket or purse, the package tends to open easily, allowing the rolling papers to fall out and to become damaged. Further, the open package allows the remaining papers to be exposed to the elements, or to be crushed or deformed if the package is quickly inserted into the smoker's pocket. In other words, the cover can become deformed if the smoker does not purposefully hold the pack closed during its insertion into a pocket or case.

Another deficiency is a lack of a tray to hold tobacco product when the smoker drops or scoops tobacco in a rolling paper. In general, excess tobacco may be spilled and/or removed from the rolling paper during the rolling process, and without a tray or something similar to hold it, the tobacco can be contaminated with foreign material from the nearby surfaces. In other words, tobacco can be lost if the smoker does not purposefully capture the excess while rolling a cigarette. This contamination and loss of costly tobacco product is unacceptable.

Hence, it would be desirable to provide a suitable package for rolling papers that provides a reliable and secure closure so that the rolling papers do not slip out, as well as including a tamper-resistant seal for ensuring a factory-fresh product. Further, it would be desirable to provide a suitable tray for the package that provides a reliable and convenient holder so that the expensive tobacco product is not lost or contaminated.

Accordingly, the present invention provides a secure closure for the package which contains the rolling papers, as well as a tamper-resistant seal for keeping the papers secure until the package is opened by the smoker. Further, the present invention provides a convenient tray for the package which holds excess tobacco while the smoking article is prepared by the smoker.

SUMMARY OF THE INVENTION

Therefore, one object of the present invention is to provide a secure closure for the package which contains the rolling papers, as well as a tamper-resistant seal for keeping the papers secure until the package is opened by the smoker.

Another object of the present invention is to provide a convenient tray for the package which holds excess tobacco while the smoking article is prepared by the smoker.

These and other objects, features, and advantages will become apparent as reference is made to the following detailed description, preferred embodiments, and examples, given for the purpose of disclosure, and taken in conjunction with the accompanying drawings and appended claims.

BRIEF DESCRIPTION OF DRAWINGS

For a further understanding of the nature and objects of the present inventions, reference should be made to the following detailed disclosure, taken in conjunction with the accompanying drawings, in which like parts are given like reference numerals, and wherein.

DESCRIPTION OF THE DISCLOSURE

The following detailed description of various embodiments of the present invention references the accompanying drawings, which illustrate specific embodiments in which the invention can be practiced. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto to be limited to the examples and descriptions set forth herein but rather that the claims be construed as encompassing all the features of patentable novelty which reside in the present invention, including all features which would be treated as equivalents thereof by those skilled in the art to which the invention pertains. Therefore, the scope of the present invention is defined only by the appended claims, along with the full scope of equivalents to which such claims are entitled.

Figure 1:
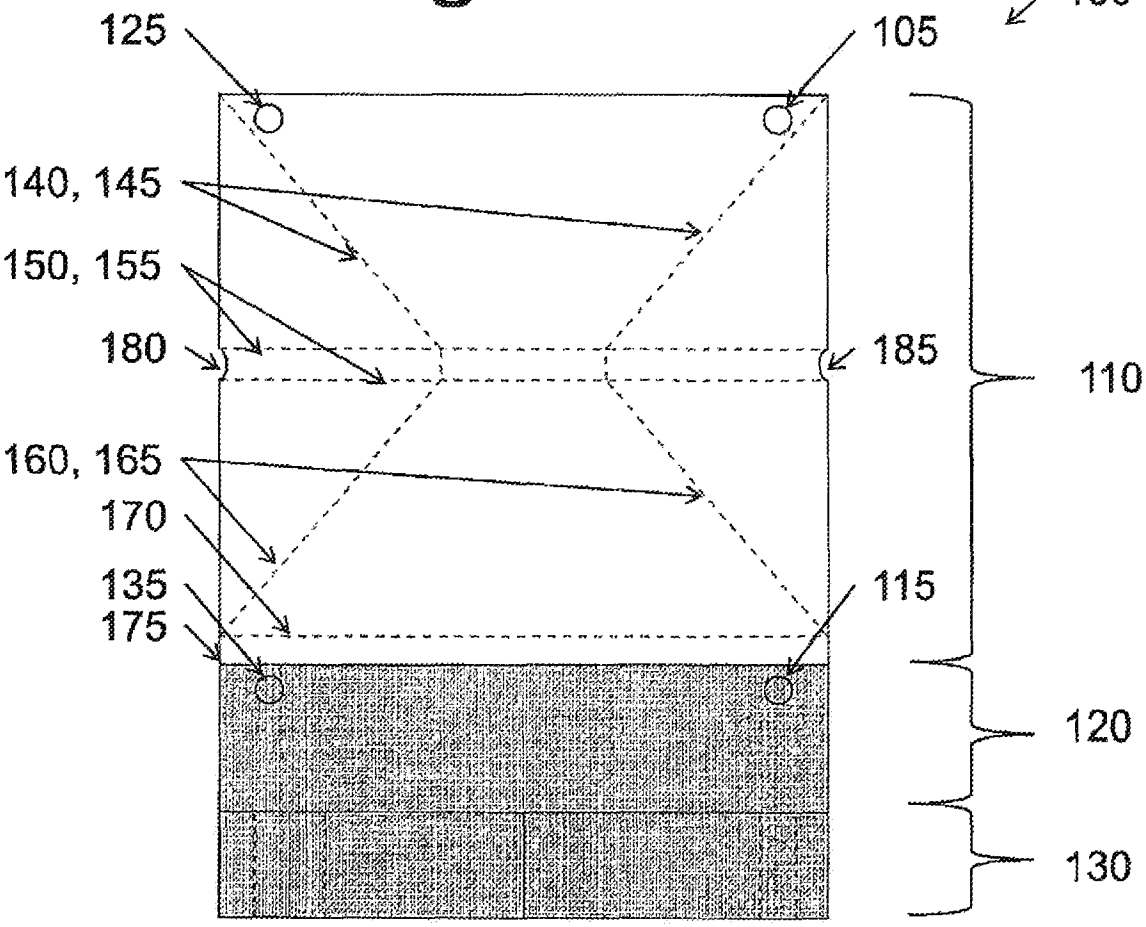
FIG. 1 is a perspective view of an exemplary open, reclosable package with an unfolded tray.

A perspective view of an exemplary open, reclosable package with an unfolded tray is shown in FIG. 1. As shown in FIG. 1, the reclosable package 100 comprises a tray portion 110 and a rolling paper pack portion 120 and may comprise a rolling tip portion 130. The package 100 may be made of a stiff paper or cardboard material or a thin plastic.

The package 100 may be sized to accommodate a wide variety of rolling paper packs and rolling tip packs. Generally, the tray portion 110 may be sized to fold over the rolling paper pack 120 and the optional rolling tip pack 130 portions of the package 100 when a full rolling paper pack 300 is affixed to the rolling paper pack portion 120 and a full rolling tip pack 400 is affixed to the rolling tip pack portion 130. According, the tray portion 110 may be about twice the length of the combined rolling paper pack 120 and rolling tip pack portions 130.

In an embodiment, the unfolded package 100 measures about 147.5 mm by about 110 mm. The tray portion 110 measures about 102.5 mm by about 110 mm, the rolling paper pack portion 120 about 26 mm by about 110 mm and the rolling tip pack portion 130 about 19 mm by about 110 mm. In a preferred embodiment, the rolling tip portion comprises two adjacent rolling tip areas about 19 mm by about 55 mm.

The tray portion 110 comprises a plurality of folds (e.g., 140 through 175) to form a bowl-shape. The folds may be straight and/or curved to form the desired shape.

In an embodiment, the tray portion has a central fold (e.g., 150 and/or 155), a lower fold (e.g., 170 and/or 175) and a plurality of diagonal folds (e.g., 140, 145, 160 and 165). In a preferred embodiment, the lower fold (e.g., 170 and/or 175) between the tray portion 110 and the rolling paper pack portion 120 is perforated to remove the tray 110 from the package 100, if desired.

In a preferred embodiment, the tray portion 110 has a pair of central folds 150, 155, a pair of lower folds 170, 175 and a plurality of diagonal folds 140, 145, 160 and 165. In an especially preferred embodiment, the lower fold 175 is perforated to remove the tray 110, if desired. In another especially preferred embodiment, a pair of notches are formed in the opposing edges 180, 185 of the tray between the pair of central folds 150, 155. The edges 180, 185 are notched to hold an elastic band 190 (shown in FIG. 2) in place.

Figure 2:
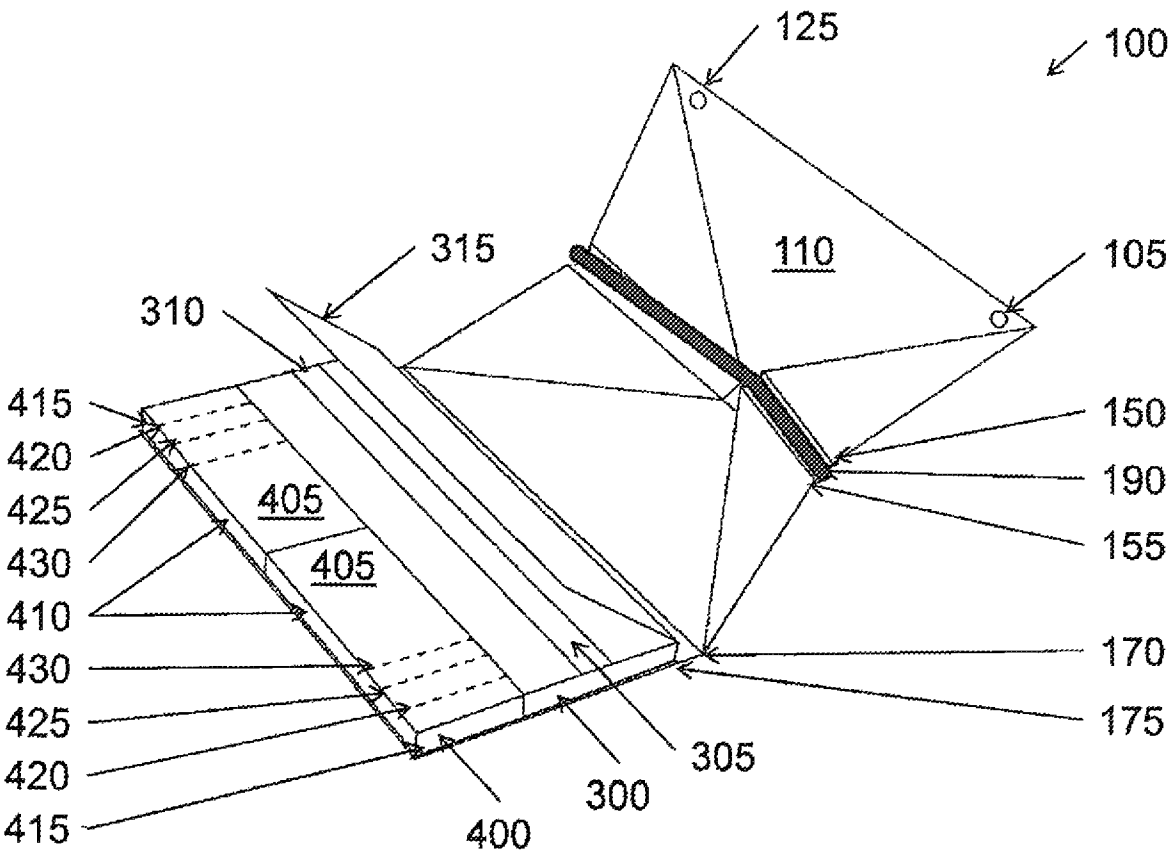
FIG. 2 is a perspective view of an exemplary open, reclosable package with an automatic tray.

A perspective view of an exemplary open, reclosable package with an automatic tray is shown in FIG. 2. As shown in FIG. 2, the reclosable package 100 further comprises an elastic band 190 that is disposed around the outside surface of the tray 110 between the pair of central folds 150, 155. In an embodiment, the elastic band 190 automatically contracts to form a bowl-shaped tray 110 when the package 100 is opened and expands to flatten the tray 110 when the package 100 is closed. In another especially preferred embodiment, a pair of notches are formed in the opposing edges 180, 185 of the tray between the pair of central folds 150, 155 to hold the elastic band 190 in place, as discussed above.

Figure 3:
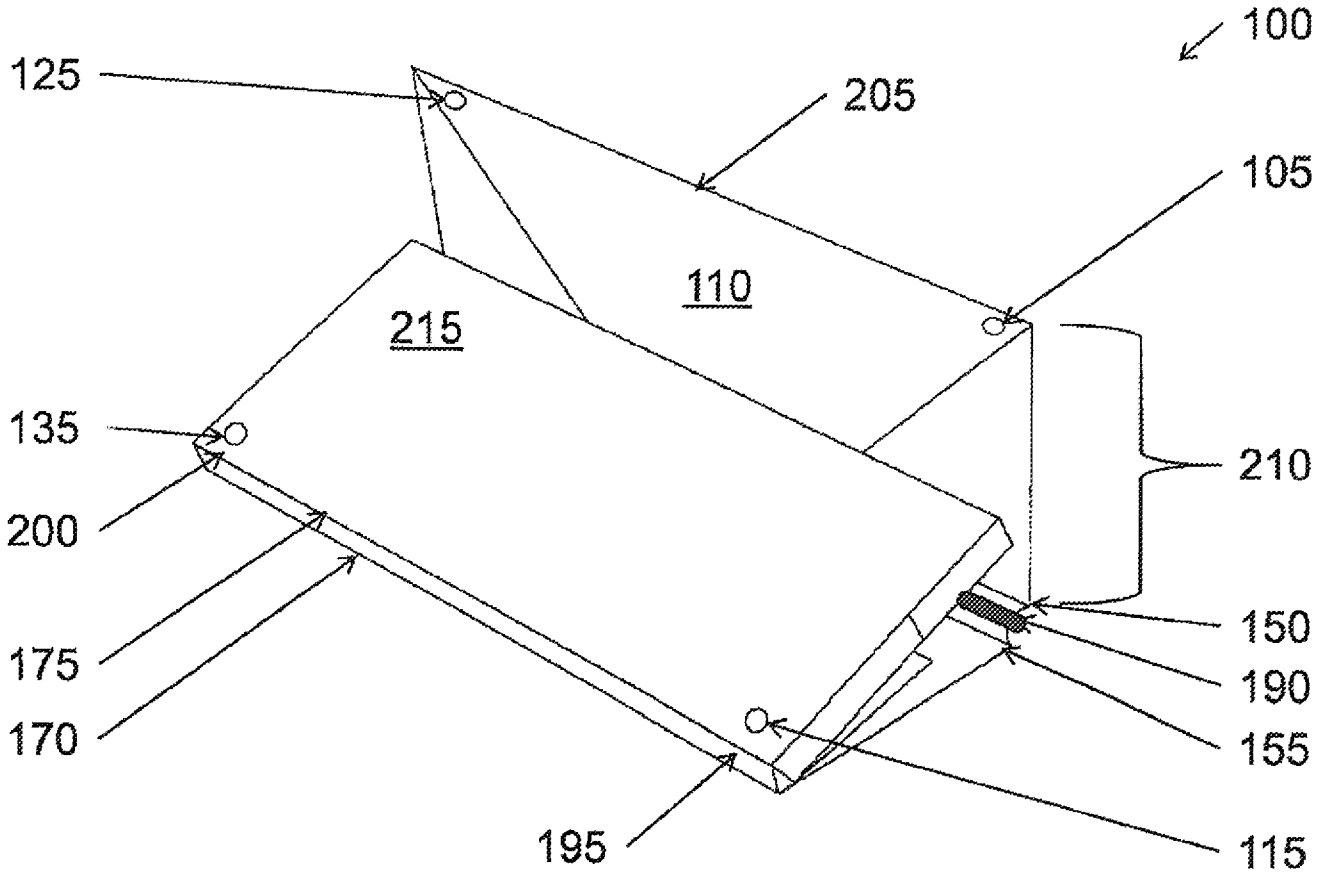
FIG. 3 is a perspective view of an exemplary partially-closed, reclosable package with a magnetic clasp and an automatic tray.
Figure 4:
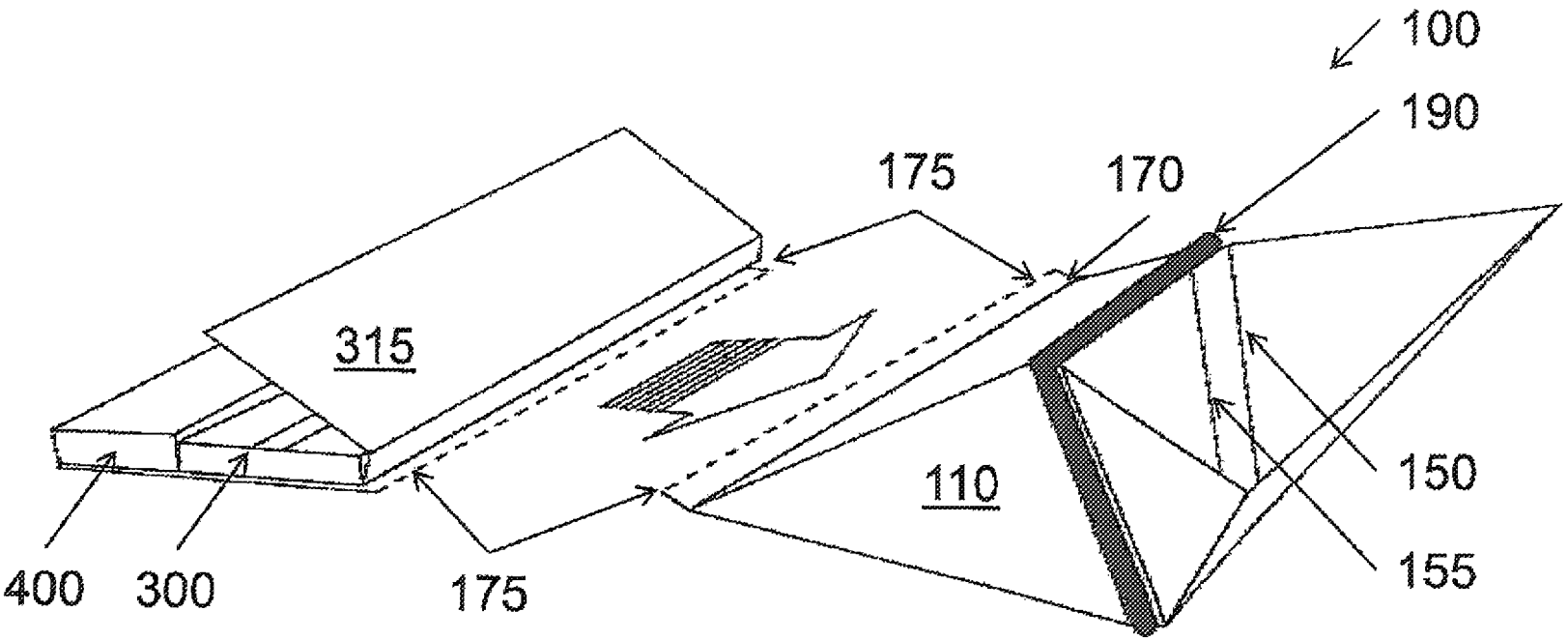
FIG. 4 is a perspective view of an exemplary open, reclosable package with a detached, automatic tray.

As indicated in FIGS. 2-4, the reclosable package 100 comprises a pack of rolling papers 300 and may comprise a pack of rolling tips 400, wherein the rolling paper pack 300 and the rolling tip pack 400 are affixed to the package 100. In an embodiment, the pack of rolling papers 300 is affixed to the rolling paper pack portion 120 of the package 100 and the rolling tip pack 400 is affixed to the rolling tip portion 130 of the package 100. The rolling paper pack 300 and the rolling tip pack 400 may be affixed to the package 100 with an adhesive.

As shown in FIGS. 2 and 4, the rolling paper pack 300 comprises a plurality of rolling papers 305. In an embodiment, the rolling papers 305 may be arranged in a stack (not shown). In a preferred embodiment, the stack of rolling papers 305 may be interleaved to allow individual papers 305 to be removed through an open slot 310 in the rolling paper pack 300. The rolling paper pack 300 includes a cover 315 which may be closed to protect the rolling papers 305 when not in use. The rolling paper pack 300 may be made of a stiff paper or cardboard material or a thin plastic.

As shown in FIG. 2, the optional rolling tip pack 400 comprises a plurality of rolling tips 405. In an embodiment, the rolling tips 405 may be arranged in a stack 410. In a preferred embodiment, the rolling tip stack 410 may be held together with an adhesive along an edge (e.g., 415) of the stack 410. The rolling tip sheets 405 may be gummed along an edge (e.g., 415) to allow the smoker to easily remove one or more sheets 405, as desired.

In another preferred embodiment, the rolling tip sheets 405 may be perforated along a plurality of perforation lines (e.g., 420, 425 and 430) to allow the smoker to easily select the desired length of the rolling tip 405.

A perspective view of an exemplary partially-closed, reclosable package with magnetic clasp and an automatic tray is shown in FIG. 3. As indicated in FIG. 3, the package 100 comprises at least one closure. In an embodiment, the closure includes any fastening means to hold the package 100 closed, such as a gummed or adhesive strip, a hoof and loop fastener, an elastic band or similar closure.

In another embodiment, the package 100 has at least one magnet-based closure (e.g., 195 and/or 200). In a preferred embodiment, the package 100 has a plurality of magnet-based closures 195, 200 to allow the magnets 105, 115, 125, 135 to be positioned out of the way of dropping or scooping tobacco.

In an embodiment, a first magnet 105 (and third magnet 125) is located on the inside cover 205 of the package 100. As shown in FIGS. 1-3, an upper (and a lower portion) of the cover 205 is formed from an upper portion 210 (and a lower portion) of the tray 110. A second magnet 115 (and a fourth magnet 135) is located on the body 215 of the package 100. The second magnet 115 (and the fourth magnet 135) may be located on an inside or outside surface of the body 215 of the package 100. Alternatively, the first magnet 105 (and the third magnet 125) may be located on the body 215 of the package 100, and the second magnet 115 (and the fourth magnet 135) may be located on the inside cover 205 of the package 100.

The magnets 105, 115 in the first magnet-based closure 195 and the magnets 125, 135 in the second magnet-based closure 200 are positioned to contact one another when the cover 205 is folded downwardly to create a secure closure. In an embodiment, the magnet may be positioned on the cover about 2 mm from a front edge at about a midpoint between the two sides and on the body about 2 mm from a rear edge at about a midpoint between the two sides. In a preferred embodiment, the magnets are positioned on the cover about 2 mm from a front edge and about 6.5 mm from a side edge and on the body about 2 mm from a rear edge and about 6.5 mm from a side edge.

In an embodiment, the first magnet 105 (and the third magnet 125) is made of a magnetic metallic material, and the second magnet 115 (and the fourth magnet 135) is made of a magnetic composite material. Alternatively, the first magnet 105 (and the third magnet 125) may be made of a magnetic composite material, and the second magnet 115 (and the fourth magnet 135) may be made of a metallic material. Alternatively, one magnet could be made of a magnetic material, and the other magnet could be made of a metallic material (e.g., base iron). However, eventually the magnetic material will magnetize the metallic material.

In an embodiment, the magnetic metallic material and the magnetic composite material may be any suitable shape, size and thickness. In a preferred embodiment, the magnetic metallic material is about 6.12 mm in diameter, and about 0.55 mm in thickness, and the magnetic composite material is about 5.00 mm in diameter, and about 0.76 mm in thickness.

In an embodiment, the second magnet 115 (and fourth magnet 135) may move gradually inward relative to its original position in the full package as papers 305 and rolling tips 405 are removed from the package. In a preferred embodiment, the second magnet 115 (and the fourth magnet 135) may be about 5.47 mm from an approximately parallel rear surface of the body 215 in the full package, and about 5.29 mm from the rear surface in the empty package. Accordingly, the magnets 115, 135 may move inward about 0.18 mm during use.

In an embodiment, the magnetic material may be any suitable material that produces a persistent magnetic field in the absence of an applied magnetic field. For example, suitable magnetic materials include: magnetic metallic elements magnetic composites. The magnetic metallic elements include: iron, cobalt, nickel, and combinations thereof. The magnetic composites include: ceramic or ferrite magnets such as a sintered composite of powdered iron oxide and barium/strontium carbonate ceramic, alnico magnets such as a sintered composite of aluminum, nickel and cobalt, triconal magnets such as alloys of titanium, cobalt, nickel and aluminum, rare earth magnets such as samarium-cobalt and neodymium-iron-boron (NIB) magnets, and combinations thereof. In a particularly preferred embodiment, the magnetic material is a sintered composite of neodymium, iron and boron to form the $Nd_2Fe_{14}B$ tetragonal crystalline structure that is currently the strongest type of magnet.

Some magnetic properties used to compare permanent magnets are remanence (M), the strength of the magnetic field, coercivity ($H_{cb}$), the materials resistance to becoming demagnetized, inner coercivity ($H_{ci}$), the material's inner resistance to becoming demagnetized, energy product ($BH_{max}$), the density of the magnetic energy, Curie temperature ($T_c$), the temperature at which the material loses its magnetism. Table 1 shows general magnetic properties for some common magnetic materials, and Table 2 shows specific magnetic properties for a preferred NIB magnetic material.

TABLE 1

General Magnetic Properties For Some Magnetic Materials

| Types of Permanent Magnets | Magnet Material | $M_r$ (T) | $H_{ci}$ (kA/m) | $BH_{max}$ (kJ/m3) | $T_c$ (° C.) |
|---|---|---|---|---|---|
| Ferrite | Sr-ferrite (sintered) | 0.2-0.4 | 100-300 | 10-40 | 450 |
| Alnico | Alnico (sintered) | 0.8-1.1 | 600-2000 | 1-88 | 700-860 |
| Rare Earth | $SmCo_5$ (sintered) | 1.0-1.4 | 750-2000 | 120-200 | 720 |
| | $Nd_2Fe_{14}B$ (sintered) | 1.0-1.4 | 750-2000 | 200-440 | 310-400 |

TABLE 1-continued

General Magnetic Properties For Some Magnetic Materials

| Types of Permanent Magnets | Magnet Material | $M_r$ (T) | $H_{ci}$ (kA/m) | $BH_{max}$ (kJ/m3) | $T_c$ (° C.) |
|---|---|---|---|---|---|
| | $Nd_2Fe_{14}B$ (sintered) | 0.6-0.7 | 600-2000 | 60-100 | 310-400 |

TABLE 2

Specific Magnetic Properties For A Preferred NIB Magnetic Material

| Type | Magnet Material | $M_r$ (T) | $H_{cb}$ (kA/m) | $H_{ci}$ (kA/m) | $BH_{max}$ | $T_{operation}$ |
|---|---|---|---|---|---|---|
| Rare Earth | $Nd_2Fe_{14}B$ (sintered)[1] | 1.17-1.21 | 868 | 955 | 263-287 | 80 |

[1]The preferred NIB magnetic material may have a superficial treatment of Zinc, and an axial magnetization where one site pole is North[1] and the other site pole is South A perspective view of an exemplary open, reclosable package with a detached, automatic tray is shown in FIG. 4. As shown in FIG. 4, the tray portion 110 has been removed from the rolling paper pack portion 120 of the package 100 along the lower fold 175. In a preferred embodiment, the lower fold 175 is perforated to allow the smoker to easily remove the tray 110 if desired.

In an embodiment, the elastic band 190 automatically contracts to form a bowl-shaped tray 110 when the package 100 is opened/or removed. In a preferred embodiment, a pair of notches are formed in the opposing edges 180, 185 of the tray between the pair of central folds 150, 155 to hold the elastic band 190 in place, as discussed above.

Figure 5:
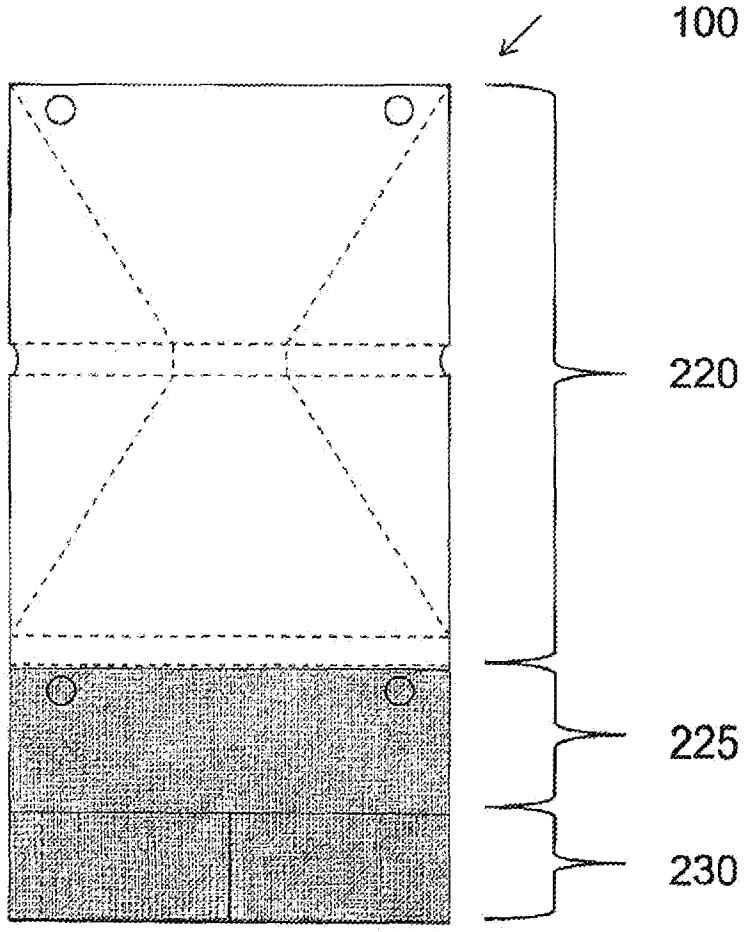
FIG. 5 is a perspective view of another exemplary open, reclosable package with an unfolded tray.

A perspective view of another exemplary open, reclosable package with an unfolded tray is shown in FIG. 5. As indicated in FIG. 5, the reclosable package 100 comprises a tray portion 220 and a rolling paper pack portion 225 and may comprise a rolling tip portion 230.[1] When a magnet is freely suspended, the magnet's North pole points towards the Earth's magnetic North pole in northern Canada.

The package 100 may be sized to accommodate a wide variety of rolling paper packs and/or rolling tip packs, as discussed above. Regardless of the dimensions of the rolling paper pack 225 and rolling tip pack 230 portions, the tray portion 220 may be sized to fold over the rolling paper pack 225 and the optional rolling tip pack 230 portions of the package 100 when a full rolling paper pack 300 is affixed to the rolling paper pack portion 225 and a full rolling tip pack 400 is affixed to the rolling tip pack portion 230. According, the tray portion 220 may be about twice the length of the combined rolling paper pack 225 and rolling tip pack portions 230.

In an embodiment, the unfolded package 100 measures about 147.5 mm by about 78 mm. The tray portion 220 measures about 102.5 mm by about 78 mm, the rolling paper pack portion 225 about 26 mm by about 78 mm and the rolling tip pack portion 230 about 19 mm by about 78 mm. In a preferred embodiment, the rolling tip portion comprises two adjacent rolling tip areas about 19 mm by about 39 mm.

Figure 6:
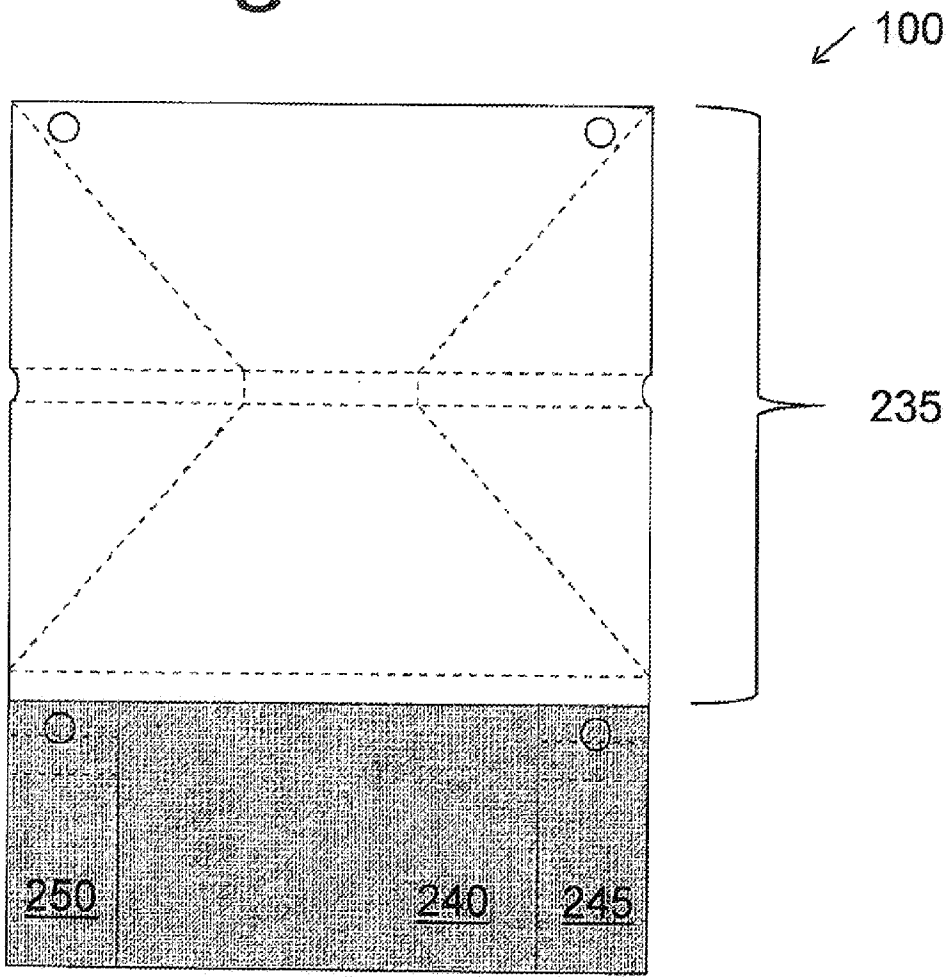
FIG. 6 is a perspective view of yet another exemplary open, reclosable package with an unfolded tray.

A perspective view of yet another exemplary open, reclosable package with an unfolded tray is shown in FIG. 6. As shown in FIG. 6, the reclosable package 100 comprises a tray portion 235 and a rolling paper pack portion 240 and may comprise a plurality of rolling tip pack portions (e.g., 245, 250).

The package 100 may be sized to accommodate a wide variety of rolling paper pack and/or rolling tip pack configurations. Regardless of the arrangement of the rolling pack 240 and rolling tip pack portions 245, 250, the tray portion 235 may be sized to fold over the rolling paper pack 240 and the optional rolling tip pack 245, 250 portions of the package 100 when a full rolling paper pack 300 is affixed to the rolling paper pack portion 240 and full rolling tip packs 400 are affixed to the rolling tip pack portions 245, 250. According, the tray portion 235 may be about twice the length of the combined rolling paper pack 240 and rolling tip pack portions 245, 250.

In an embodiment, the unfolded package 100 measures about 147.5 mm by about 110 mm. The tray portion 235 measures about 102.5 mm by about 110 mm, the rolling paper pack portion 240 about 45 mm by about 72 mm and the two rolling tip pack portions 245, 250 about 45 mm by about 19 mm.

Figure 7:
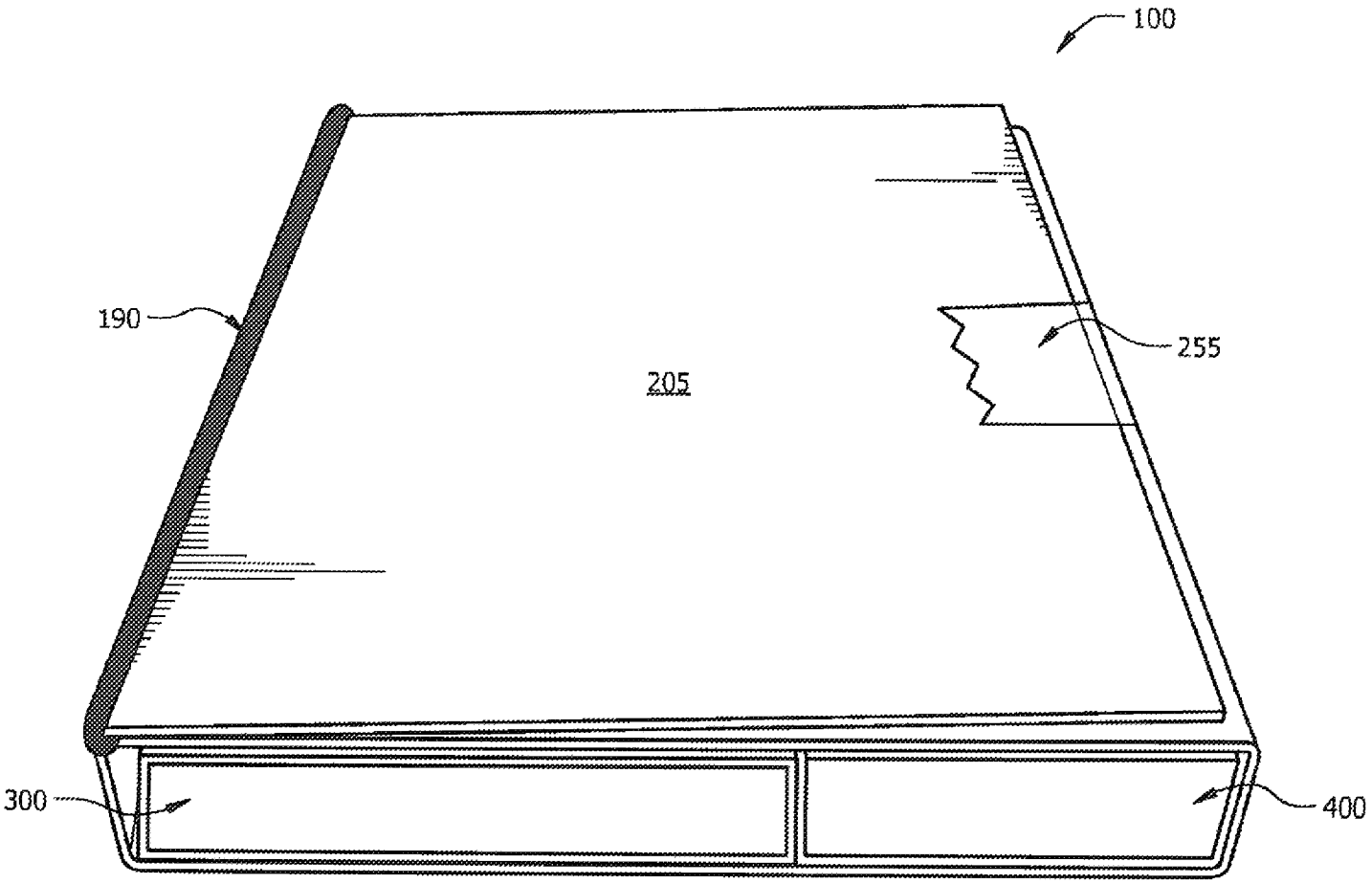
FIG. 7 is a perspective view of a sealed reclosable package with an automatic tray.

A perspective view of an exemplary closed, reclosable package with an adhesive seal is shown in FIG. 7. As shown in FIG. 7, a tamper-resistant adhesive seal 255 may be affixed across the cover 205 when the package 100 is closed. The adhesive seal 255 indicates to the smoker that the rolling papers 305 and the rolling tips 405 in the package 100 should be factory fresh and tamper-free. The seal 255 may be easily removed or broken to access the rolling papers 305 and the rolling tips 405. In a preferred embodiment, the seal 255 may be a foil-type sticker adhesively applied by the manufacturer.

As can be seen for the foregoing description of the preferred and alternate embodiments, the present invention is intended to provide a highly transparent cellophane wrapping paper with a suitable adhesive so that it can easily be dispensed and used to securely wrap smoking materials. Also, a novel means of securing the closure of the package is provided. Although exemplary embodiments of the present invention have been shown and described, many changes, modifications, and substitutions may be made by one having ordinary skill in the art without necessarily departing from the spirit and scope of the invention.

DEFINITIONS

As used herein, the terms "a," "an," "the," and "said" means one or more.

As used herein, the terms "comprising," "comprises," and "comprise" are open-ended transition terms used to transition from a subject recited before the term to one or elements recited after the term, where the element or elements listed after the transition term are not necessarily the only elements that make up of the subject.

As used herein, the terms "containing," "contains," and "contain" have the same open-ended meaning as "comprising," "comprises," and "comprise," provided above.

As used herein, the terms "having," "has," and "have" have the same open-ended meaning as "comprising," "comprises," and "comprise," provided above.

As used herein, the terms "including," "includes," and "include" have the same open-ended meaning as "comprising," "comprises," and "comprise," provided above.

INCORPORATION BY REFERENCE

All patents and patent applications, articles, reports, and other documents cited herein are fully incorporated by reference to the extent they are not inconsistent with this invention

What is claimed is:

1. A reclosable package for containing smoking papers to be dispensed therefrom, the package comprising:
- a body for holding the smoking papers;
- the body having a cover which overlays a surface of the body of the package for closure;
- wherein the cover opens to form a tray; and
- wherein the cover and/or body include a closure positioned to form a clasp when the cover is folded over the body; and
- wherein the tray further comprises a plurality of folds, the plurality of folds forming a bowl shape, the plurality of folds comprising:
- a lower fold located between the cover and the body section;
- a central fold; and
- a plurality of diagonal folds, wherein each diagonal fold runs from a corner of the tray towards the central fold forming the bowl shape.

2. The package of claim 1, wherein the cover and body include a magnet and a metallic material positionally mounted to contact one another to form a clasp when the cover is folded toward the body.

3. The package of claim 1, wherein the body further comprises:
- a rolling paper pack; and
- a rolling tip pack.

4. The package of claim 1, wherein the body further comprises:
- a cover which overlays the front and rear surfaces of the body of the package for closure.

5. The package of claim 1, wherein the lower fold is perforated.

6. The package of claim 1, wherein the plurality of folds comprises:
- a plurality of central folds;
- a plurality of lower folds located between the tray and the body section; and
  - a plurality of diagonal folds, wherein each diagonal fold runs from a corner of the tray towards one of the central folds forming the bowl shape.

7. The package of claim 6, wherein a rubber band is disposed around the outside surface of the tray between the pair of central folds and held in place by the pair of opposing notches.

8. The package of claim 7, wherein the rubber band contracts to form the bowl-shaped tray when the package is open.

9. The package of claim 6, wherein at least one of the lower folds is perforated.

10. The package of claim 2, wherein the cover includes the magnet and the body includes the metallic material.

11. The package of claim 2, wherein the body includes the magnet and the cover includes the metallic material.

12. The package of claim 2, wherein the body and cover include a magnet.

13. A reclosable package for containing smoking papers to be dispensed therefrom, the package comprising:
- a body for holding the smoking papers;
- the body having a cover which overlays a surface of the body of the package for closure;
- wherein the cover opens to form a tray; and
- wherein the cover and/or body include a closure positioned to form a clasp when the cover is folded over the body; and wherein the cover further comprises a plurality of folds, the plurality of folds forming a bowl-shaped tray, the plurality of folds comprising:

a lower fold located between the bowl-shape tray and the body;

a central fold; and a plurality of diagonal folds, wherein each diagonal fold runs from a corner of the tray towards the central fold forming the bowl-shaped tray.

14. The package of claim 13, wherein the lower fold is perforated.

15. The package of claim 13, comprising a plurality of central folds, wherein a first and a second central fold are approximately parallel to each other and to the lower fold between the tray and the body and wherein a pair of notches are formed in opposing edges of the tray between the first and the second central folds.

16. The package of claim 15, wherein a rubber band is disposed around the outside surface of the tray between the pair of central folds and held in place by the pair of opposing notches, wherein the rubber band contracts to form a bowl-shaped tray when the package is open.

17. The package of claim 15, comprising a plurality of lower folds, wherein at least one of the lower folds is perforated.

* * * * *